US010125718B1

(12) United States Patent
Peschini et al.

(10) Patent No.: US 10,125,718 B1
(45) Date of Patent: Nov. 13, 2018

(54) ENGINE BLOCK INCLUDING AN INTEGRATED FLOW CHANNEL

(71) Applicant: GM GLOBAL TECHNOLOGY OPERATIONS LLC, Detroit, MI (US)

(72) Inventors: Luca Peschini, Cesano Maderno (IT); Aniello Marrone, Turin (IT); Silvio Domenico Mosso, Rivoli (IT)

(73) Assignee: GM Global Technology Operations LLC, Detroit, MI (US)

( * ) Notice: Subject to any disclaimer, the term of this patent is extended or adjusted under 35 U.S.C. 154(b) by 7 days.

(21) Appl. No.: 15/592,649

(22) Filed: May 11, 2017

(51) Int. Cl.

| | |
|---|---|
| ***F02M 25/07*** | (2006.01) |
| ***F02F 1/10*** | (2006.01) |
| ***F01P 3/02*** | (2006.01) |
| ***F02B 3/06*** | (2006.01) |
| ***F02M 26/65*** | (2016.01) |
| ***F02M 26/13*** | (2016.01) |
| ***F02M 26/14*** | (2016.01) |
| *F02M 26/00* | (2016.01) |

(52) U.S. Cl.
CPC ..... *F02F 1/10* (2013.01); *F01P 3/02* (2013.01); *F02B 3/06* (2013.01); *F02M 26/13* (2016.02); *F02M 26/14* (2016.02); *F02M 26/65* (2016.02); *F02M 2026/001* (2016.02)

(58) Field of Classification Search
CPC ..... F02F 2001/104; F02F 2001/106; F02M 26/65; F02M 26/73; F02M 2026/001; F02M 26/13; F02M 26/14; F02M 26/16; F02M 26/17; F02M 26/23; F02M 26/29
See application file for complete search history.

(56) References Cited

U.S. PATENT DOCUMENTS

2012/0166070 A1* 6/2012 Katou ..... F02D 41/0065 701/108

* cited by examiner

*Primary Examiner* — Jacob Amick
(74) *Attorney, Agent, or Firm* — Quinn IP Law

(57) ABSTRACT

A cast-aluminum engine block for a compression-ignition internal combustion engine includes a plurality of cylinders that are disposed in an in-line arrangement. The engine block includes a top portion including a top deck and a bottom portion including a plurality of main bearings that are disposed to support journals of a crankshaft. An integrated flow channel is formed between the second end and the last cylinder and proximal to the top deck, and is a continuous channel that passes from the first side to the second side through the portion of the engine block between the second end and the last cylinder and proximal to the top deck. A coolant passageway is disposed in the engine block between the integrated flow channel and the last cylinder, and is oriented parallel to the elevation axis.

18 Claims, 3 Drawing Sheets

ENGINE BLOCK INCLUDING AN INTEGRATED FLOW CHANNEL

INTRODUCTION

An internal combustion engine is composed of an engine block that provides a structure for reciprocating pistons and a crankshaft, a cylinder head that manages intake air and exhaust flow to the pistons, an intake air manifold, an exhaust manifold, and a crankcase. The engine block also provides structure for coupling a geartrain to an end of the crankshaft to transfer generated mechanical power.

SUMMARY

An engine block for a compression-ignition internal combustion engine is described, and includes a cast-aluminum engine block having a first end and a second end in relation to a longitudinal axis, and a first side and a second side in relation to a transverse axis. The engine block includes a plurality of sleeved cylinder barrels that define a plurality of cylinders that are disposed in an in-line arrangement along the longitudinal axis, and a last cylinder is defined as being the one of the cylinder barrels that is disposed proximal to the second end. The engine block includes a top portion including a top deck and a bottom portion including a plurality of main bearings that are disposed to support journals of a crankshaft, wherein the top and bottom portions are in relation to an elevation axis. The engine block includes a transmission flange that is disposed at the second end. An integrated flow channel is formed within a portion of the engine block between the second end and the last cylinder and proximal to the top deck. The integrated flow channel is a continuous channel that is aligned with the transverse axis and is disposed to pass from the first side to the second side through the portion of the engine block between the second end and the last cylinder and proximal to the top deck. A coolant passageway is disposed in the engine block between the integrated flow channel and the last cylinder, and is oriented parallel to the elevation axis.

An aspect of the disclosure includes the cast-aluminum engine block being formed via a precision sand casting process.

Another aspect of the disclosure includes the top deck being disposed to accommodate a cylinder head.

Another aspect of the disclosure includes a slip-fit cylinder liner sleeve composed from iron being inserted into each of the cylinder barrels.

Another aspect of the disclosure includes the cylinder barrels being disposed to receive pistons.

Another aspect of the disclosure includes a plurality of air insulation pockets being formed in the engine block that are annular to the last cylinder.

Another aspect of the disclosure includes the integrated flow channel having a rounded rectangular cross-sectional shape.

Another aspect of the disclosure includes the integrated flow channel having an irregular concave polygonal cross-sectional shape Another aspect of the disclosure includes a portion of an inner surface area of the integrated flow channel that is adjacent to the portion of the cylinder block that forms the last cylinder being minimized.

Another aspect of the disclosure includes a first flange mount being disposed on the first side of the engine block at a first end of the integrated flow channel, and a second flange mount being disposed on the second side of the engine block at a second end of the integrated flow channel.

Another aspect of the disclosure includes an internal combustion engine that includes a cylinder head fluidly coupled to an air intake manifold and an exhaust manifold and an exhaust gas recirculation valve that is disposed to regulate the flow of exhaust gas from the exhaust manifold to the air intake manifold, wherein the cylinder head is disposed on an engine block. The engine block is a cast-aluminum engine block having a first end and a second end in relation to a longitudinal axis, and a first side and a second side in relation to a transverse axis. The engine block includes a plurality of sleeved cylinder barrels defining a plurality of cylinders that are disposed in an in-line arrangement along the longitudinal axis, wherein a last cylinder is defined as being the one of the cylinder barrels that is disposed proximal to the second end. The engine block also has a top portion including a top deck and a bottom portion including a plurality of main bearings that are disposed to support journals of a crankshaft, wherein the top and bottom portions are in relation to an elevation axis and the cylinder head is disposed on the top deck. The engine block also includes a transmission flange disposed at the second end. An integrated flow channel is formed within a portion of the engine block between the second end and the last cylinder and proximal to the top deck, wherein the integrated flow channel is a continuous channel that is aligned with the transverse axis and is disposed to pass from the first side to the second side through the portion of the engine block between the second end and the last cylinder and proximal to the top deck. A coolant passageway is interposed in the engine block between the integrated flow channel and the last cylinder. The integrated flow channel is fluidly coupled between the exhaust manifold and the exhaust gas recirculation valve.

The above features and advantages, and other features and advantages, of the present teachings are readily apparent from the following detailed description of some of the best modes and other embodiments for carrying out the present teachings, as defined in the appended claims, when taken in connection with the accompanying drawings.

BRIEF DESCRIPTION OF THE DRAWINGS

One or more embodiments will now be described, by way of example, with reference to the accompanying drawings, in which.

Figure 1:
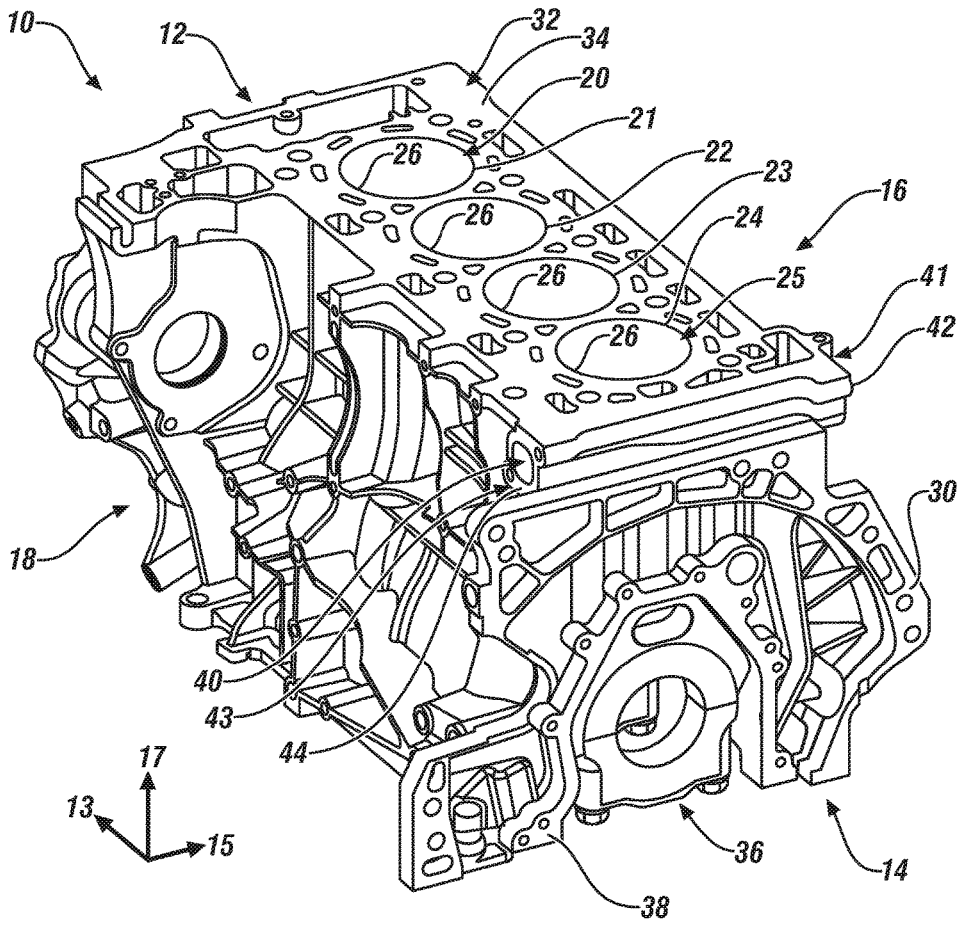
FIG. 1 schematically shows a three-dimensional isometric view of an engine block, in accordance with the disclosure.

It should be understood that the appended drawings are not necessarily to scale, and present a somewhat simplified representation of various preferred features of the present disclosure as disclosed herein, including, for example, specific dimensions, orientations, locations, and shapes. Details associated with such features will be determined in part by the particular intended application and use environment.

DETAILED DESCRIPTION

The components of the disclosed embodiments, as described and illustrated herein, may be arranged and designed in a variety of different configurations. Thus, the following detailed description is not intended to limit the scope of the disclosure, as claimed, but is merely representative of possible embodiments thereof. In addition, while numerous specific details are set forth in the following description in order to provide a thorough understanding of the embodiments disclosed herein, some embodiments can be practiced without some or all of these details. Moreover, for the purpose of clarity, certain technical material that is known in the related art has not been described in detail in order to avoid unnecessarily obscuring the disclosure. Furthermore, the drawings are in simplified form and are not to precise scale. For purposes of convenience and clarity only, directional terms such as top, bottom, left, right, up, over, above, below, beneath, rear, and front, may be used with respect to the drawings. These and similar directional terms are not to be construed to limit the scope of the disclosure. Furthermore, the disclosure, as illustrated and described herein, may be practiced in the absence of an element that is not specifically disclosed herein. As employed herein, the term "upstream" and related terms refer to elements that are towards an origination of a flow stream relative to an indicated location, and the term "downstream" and related terms refer to elements that are away from an origination of a flow stream relative to an indicated location.

Referring to the drawings, wherein like reference numerals correspond to like or similar components throughout the several Figures, FIGS. 1-4, consistent with embodiments disclosed herein, schematically illustrate various perspectives of an engine block 10 that is a portion of an internal combustion engine. The internal combustion engine may be disposed in a vehicle that may include, but not be limited to a mobile platform in the form of a commercial vehicle, industrial vehicle, agricultural vehicle, passenger vehicle, aircraft, watercraft, train, all-terrain vehicle, personal movement apparatus, robot and the like to accomplish the purposes of this disclosure.

The internal combustion engine includes an air intake system, an exhaust system, and an exhaust gas recirculation (EGR) system (not shown). The EGR system is composed of conduits and a controllable EGR valve that are arranged to controllably channel a portion of engine exhaust gas into the air intake system, wherein the recirculated exhaust gas mixes with intake air. Expected performance benefits from the introduction of the recirculated exhaust gas into the intake air may include a reduction in combustion temperatures, which may result in improved exhaust emissions. As set forth in detail herein, one of the conduits of the EGR system can be advantageously configured as an integrated flow channel 40 that is formed within a portion of the block casting of the engine block 10. The integrated flow channel 40 is preferably integrated into an EGR system that is employed to control flow of recirculated exhaust gases into an air intake system of the engine, in conjunction with other conduits and an EGR valve. One embodiment of an internal combustion engine with an EGR system is described and schematically depicted with reference to FIG. 5.

Referring now to FIG. 1, the engine block 10 for the internal combustion engine is preferably configured for compression-ignition operation, e.g., a diesel engine. The engine block 10 is also configured to be adaptable to either a transverse mounting arrangement or a longitudinal mounting arrangement. The engine block 10 is also configured to be adaptable to an internal combustion engine that is designed to provide high performance and also be adaptable to an internal combustion engine that is designed to provide high efficiency. The description of the engine block 10 is provided in context of a three-dimensional coordinate system that includes a longitudinal axis 13, a transverse axis 15 and an elevation axis 17. The engine block 10 is preferably fabricated from an aluminum alloy that is formed by a precision sand casting process in one embodiment, or another suitable aluminum casting technique, such as a high pressure die cast process, a low pressure die cast process or a gravity die cast process.

The engine block 10 includes a first end 12 and a second end 14 that are defined in relation to the longitudinal axis 13, a first side 16 and a second side 18 that are defined in relation to the transverse axis 15, and a top portion 32 and a bottom portion 36 that are defined in relation to the elevation axis 17. As described herein, the first end 12 is associated with a front portion of the internal combustion engine, and the second end 14 is associated with a rear portion of the internal combustion engine. Although not illustrated herein, the first end 12 can be designed to mount or otherwise accommodate air conditioning compressors, cooling fans, alternators, and other components that can be driven by pulley(s) that couple to an engine crankshaft. The second end 14 can be designed to include a transmission flange 30. As described herein, the first side 16 is associated with engine exhaust and the second side 18 is associated with air intake. As described herein, the top portion 32 includes a top deck 34 that provides mounting structure for a cylinder head 49 and the bottom portion 36 includes a bottom deck 38 that provides a mounting structure that includes a plurality of main bearings that are disposed to support journals for the engine crankshaft (not shown).

The engine block 10 includes a plurality of cylinders 20 that are arranged in an in-line configuration along the longitudinal axis 13. As shown, the engine block 10 is arranged to include four cylinders 20 that are arranged along the longitudinal axis 13 from the first end 12 to the second end 14, including a first cylinder 21, a second cylinder 22, a third cylinder 23 and a fourth cylinder 24. The quantity of the cylinders 20 is illustrative, and other quantities of the cylinders 20 may be employed within the scope of this disclosure. Each of the cylinders 20 includes a cylinder barrel that has been formed from aluminum as an integral part of the engine block 10, with a sleeved liner 26 being inserted therein. In one embodiment, the sleeved liners 26 are slip-fit type liners that are inserted and thermally fit therein. In one embodiment, the sleeved liners 26 are fabricated from iron. Other suitable embodiments of sleeved liners 26 may include machined-OD (Outside Diameter) liners, cast-OD liners, or hybrid liners. One of the cylinders 20 is identified as a last cylinder 25, which is defined as the one of the cylinders 20 that is disposed proximal to the second end 14 near the transmission flange 30. In this embodiment, the fourth cylinder 24 is defined as the last cylinder 25.

The engine block 10 includes the integrated flow channel 40 that is part of the block casting and is formed within a portion of the engine block 10 that is between the second end 14 and the last cylinder 25, and is proximal to the top deck 34. The integrated flow channel 40 is a continuous channel that is aligned with the transverse axis 15 and has a rounded rectangular cross-sectional shape in one embodiment. Alternatively, the integrated flow channel 40 may have a suitable cross-sectional shape, including, e.g., a round shape, an oval shape, or an irregular shape, such as an irregular concave polygonal cross-sectional shape, wherein at least one of the interior angles thereof is greater than 180 degrees. One example of an irregular concave polygonal cross-sectional shape is an L-shape. In one embodiment, the integrated flow channel 40 has a cross-sectional area that is specified to accommodate an expected magnitude of flow of the recirculated exhaust gas. The integrated flow channel 40 is formed in the engine block 10 to minimize the portion of the inner surface area thereof that is proximal to the last cylinder 25 while fitting within an outer envelope of the engine block 10. In one embodiment, the integrated flow channel 40 is designed to accommodate an exhaust gas flowrate of a known maximum flowrate at an exhaust gas temperature of 500 C and a pressure of 2 bar. The integrated flow channel 40 is disposed to pass from the first side 16 to the second side 18 through the portion of the engine block 10 that is between the second end 14 and the last cylinder 25 and proximal to the top deck 34. The integrated flow channel 40 includes a first end 41, which is on the first, exhaust side 16 of the engine block 10, and a second end 43, which is on the second, intake side 18 of the engine block 10. An exhaust flange attachment portion 42 is formed on the outside of the engine block 10 at the first end 41 of the integrated flow channel 40. An EGR ("exhaust gas recirculation") valve attachment portion 44 is formed on the outside of the engine block 10 at the second end 43 of the integrated flow channel 40.

Figure 2:
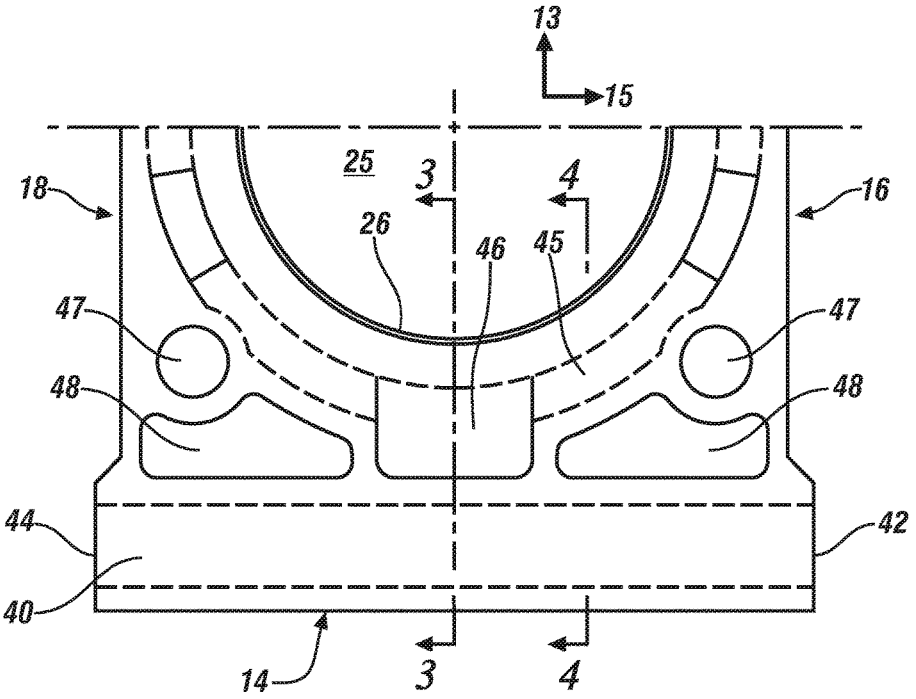
FIG. 2 schematically shows a top-view perspective of a portion of an engine block, in accordance with the disclosure.
Figure 3:
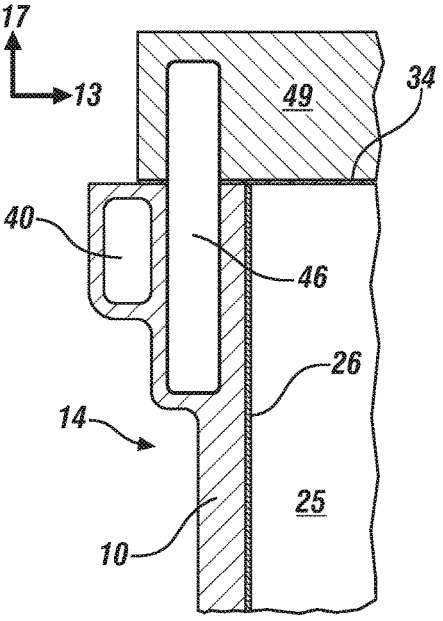
FIG. 3 schematically shows a first side-view cutaway perspective of the portion of the engine block shown with reference to FIG. 2, in accordance with the disclosure.
Figure 4:
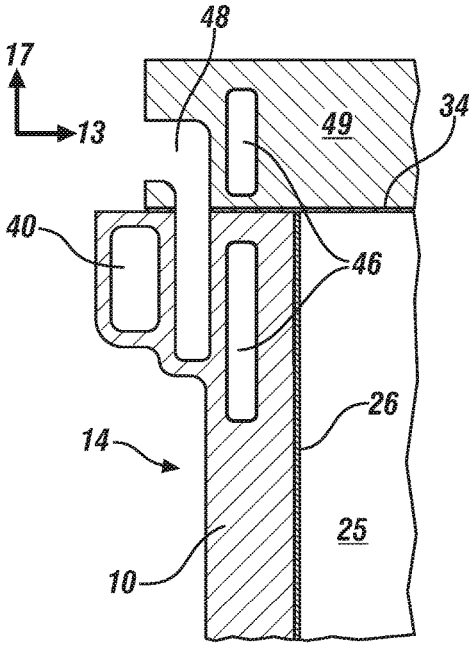
FIG. 4 schematically shows a second side-view cutaway perspective of the portion of the engine block shown with reference to FIG. 2, in accordance with the disclosure.

FIG. 2 schematically shows a top-plan view perspective of a portion of the engine block 10 that is described with reference to FIG. 1, including the second end 14 and a portion of the last cylinder 25, including the top deck 34. Elements include the integrated flow channel 40, a coolant jacket 45 including a coolant passageway 46, air pockets 48 and head-to-block orientation/mounting apertures 47. FIGS. 3 and 4 schematically show side-plan cutaway perspectives of portions of the engine block 10 and an associated cylinder head 49. This includes FIG. 3, which is a side-plan cutaway perspective of a portion of the engine block 10 shown at 3-3, as indicated on FIG. 2, and FIG. 4, which is a side-plan cutaway perspective of a portion of the engine block 10 shown at 4-4.

The coolant jacket 45 is part of an engine cooling system (not shown) that preferably includes an engine coolant pump, a radiator, a heater core, a thermostat, and related pipes, fittings and couplings that are arranged in a closed continuous circuit. The engine cooling circuit is designed and operated to manage heat transfer in the internal combustion engine, with most of the heat being generated by combustion.

The locations and orientations of the integrated flow channel 40, the coolant passageway 46 and air pockets 48 in relation to the last cylinder 25 are advantageously selected to effect heat transfer. The coolant passageway 46 is disposed in parallel with the elevation axis 17, and is arranged to permit coolant flow between the cylinder head 49 and the coolant jacket 45 of the engine block 10. It is appreciated that there are other coolant passages in the engine cooling system that are arranged to permit coolant flow between the cylinder head 49 and the coolant jacket 45 of the engine block 10. In one non-limiting embodiment, the other, non-illustrated coolant passages are arranged to permit coolant flow into the cylinder head 49, and the coolant passageway 46 is arranged as a return line from the cylinder head 49 to the coolant jacket 45.

As viewed from the top-plan view perspective that is illustrated with reference to FIG. 2, the coolant passageway 46 is interposed between the integrated flow channel 40 and the last cylinder 25. In one embodiment, the minimum longitudinal distance between the integrated flow channel 40 and the sleeved liner 26 of the last cylinder 25 is 30 mm, as measured along the longitudinal axis 13, with the interposed coolant passageway 46 having a cross-sectional distance of 15 mm. As such, at least 50% of the longitudinal distance between the integrated flow channel 40 and the sleeved liner 26 is composed of coolant that is flowing in the coolant passageway 46. Furthermore, the air pockets 48 are interposed between the sleeved liner 26 and the integrated flow channel 40. Thus, the interposed coolant passageway 46 and the air pockets 48 thermally decouple the sleeved liner 26 of the last cylinder 25 from the integrated flow channel 40, interrupting much of the conductive heat transfer therebetween.

The thermal contributors of this configuration include the following elements. The combustion process generates heat in the last cylinder 25 that can be propagated through the sleeved liner 26 and the engine block 10. The coolant being circulated can transfer heat through the engine cooling system including the coolant jacket 45 and the coolant passageway 46. The exhaust gas includes heat, including heat in the recirculated exhaust gas that flows through the integrated flow channel 40 to the EGR valve and intake air system. The air pockets 48 also contribute to heat transfer via conductive heat transfer to the ambient air. During engine operation following a cold-start event, heat from the exhaust gas in the integrated flow channel 40 can be transferred to the coolant in the coolant passageway 46, thus reducing the time to effect engine warmup. Other engine operating conditions can include, for example, high-load conditions, high ambient temperatures, steady-state load/speed conditions, etc.

FIGS. 3 and 4 schematically show side-plan cutaway perspectives of portions of the engine block 10 and the cylinder head 49. In one embodiment, and as shown, the integrated flow channel 40 has a rounded rectangular cross-sectional shape wherein a major axis of its rectangular cross-sectional shape is parallel with the elevation axis 17.

Figure 5:
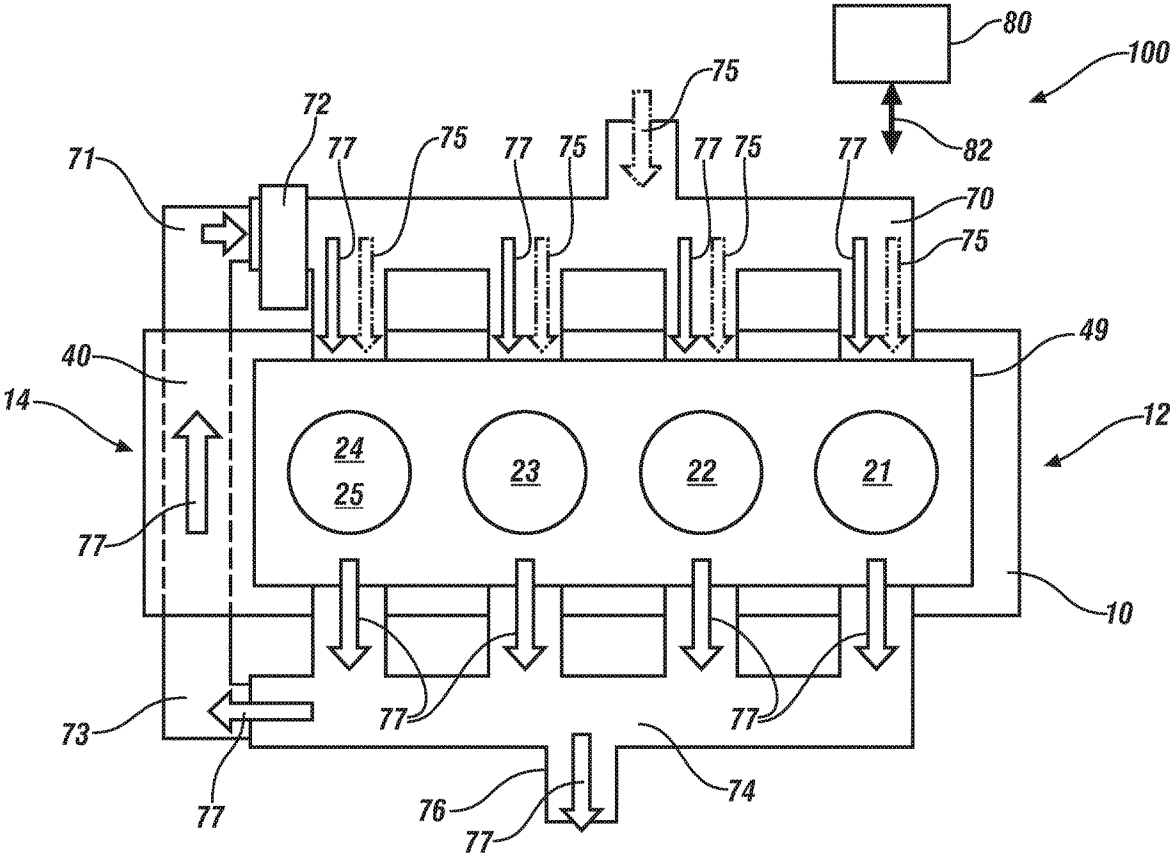
FIG. 5 schematically shows an internal combustion engine including an exhaust gas recirculation system, in accordance with the disclosure.

FIG. 5 schematically shows an internal combustion engine 100 including an exhaust gas recirculation system that is configured to incorporate the integrated flow channel 40 described with reference to FIGS. 1-4. The internal combustion engine 100 includes the engine block 10 having the integrated flow channel 40, the cylinder head 49, an intake manifold 70, an exhaust manifold 74, and an EGR valve 72. The intake manifold 70 is fluidly coupled to the intake side of the cylinder head 49 at each of the cylinders 21, 22, 23, 24, and the exhaust manifold 74 is fluidly coupled to the exhaust side of the cylinder head 49 at each of the cylinders 21, 22, 23, 24. The integrated flow channel 40 is disposed at the second end 14 of the engine block 10. The exhaust manifold 74 is fluidly coupled to an exhaust after-treatment system via an exhaust pipe 76. The integrated flow channel 40 is fluidly coupled to the exhaust manifold 74 via an exhaust-side pipe 73, and fluidly coupled to an inlet side of the EGR valve 72 via an intake side pipe 71. An outlet side of the EGR valve 72 is fluidly coupled the intake manifold 70. The EGR valve 72 is in communication with a controller 80, which controls its operation in response to engine and other operating conditions. Exhaust gas is indicated by arrows 77, and intake air is indicated by arrows 75.

The term "controller" and related terms such as control module, module, control, control unit, processor and similar terms refer to one or various combinations of Application Specific Integrated Circuit(s) (ASIC), electronic circuit(s), central processing unit(s), e.g., microprocessor(s) and associated non-transitory memory component(s) in the form of memory and storage devices (read only, programmable read only, random access, hard drive, etc.). The non-transitory memory component is capable of storing machine readable instructions in the form of one or more software or firmware programs or routines, combinational logic circuit(s), input/output circuit(s) and devices, signal conditioning and buffer circuitry and other components that can be accessed by one or more processors to provide a described functionality. Input/output circuit(s) and devices include analog/digital converters and related devices that monitor inputs from sensors, with such inputs monitored at a preset sampling frequency or in response to a triggering event. Software, firmware, programs, instructions, control routines, code, algorithms and similar terms mean controller-executable instruction sets including calibrations and look-up tables. Each controller executes control routine(s) to provide desired functions. Communication between controllers, and communication between controllers, actuators and/or sensors may be accomplished using a direct wired point-to-point link, a networked communication bus link, a wireless link or another suitable communication link, and is indicated by line 82. Communication includes exchanging data signals in suitable form, including, for example, electrical signals via a conductive medium, electromagnetic signals via air, optical signals via optical waveguides, and the like. The data signals may include discrete, analog or digitized analog signals representing inputs from sensors, actuator commands, and communication between controllers. The term "signal" refers to a physically discernible indicator that conveys information, and may be a suitable waveform (e.g., electrical, optical, magnetic, mechanical or electromagnetic), such as DC, AC, sinusoidal-wave, triangular-wave, square-wave, vibration, and the like, that is capable of traveling through a medium.

The detailed description and the drawings or figures are supportive and descriptive of the present teachings, but the scope of the present teachings is defined solely by the claims. While some of the best modes and other embodiments for carrying out the present teachings have been described in detail, various alternative designs and embodiments exist for practicing the present teachings defined in the appended claims.

What is claimed is:

1. An engine block for a compression-ignition internal combustion engine, comprising:

a cast-aluminum engine block having a first end and a second end in relation to a longitudinal axis, and a first side and a second side in relation to a transverse axis;

the engine block including a plurality of sleeved cylinder barrels defining a plurality of cylinders that are disposed in an in-line arrangement along the longitudinal axis, wherein a last cylinder is defined as being the one of the cylinder barrels that is disposed proximal to the second end;

the engine block including a top portion including a top deck and a bottom portion including a plurality of main bearings that are disposed to support journals of a crankshaft, wherein the top and bottom portions are in relation to an elevation axis;

the engine block including a transmission flange disposed at the second end;

an integrated flow channel formed within a portion of the engine block between the second end and the last cylinder and proximal to the top deck, wherein the integrated flow channel is a continuous channel that is aligned with the transverse axis and is disposed to pass from the first side to the second side through the portion of the engine block between the second end and the last cylinder and proximal to the top deck; and a coolant passageway interposed in the engine block between the integrated flow channel and the last cylinder.

2. The engine block of claim 1, wherein the coolant passageway is interposed in the engine block between the integrated flow channel, and the last cylinder is oriented parallel to the elevation axis.

3. The engine block of claim 1, further comprising a cylinder liner sleeve fabricated from iron being inserted into each of the cylinder barrels.

4. The engine block of claim 3, wherein the cylinder barrels are disposed to receive pistons.

5. The engine block of claim 1, further comprising a plurality of air insulation pockets formed in the engine block that are annular to the last cylinder and are interposed between the integrated flow channel and the last cylinder.

6. The engine block of claim 1, wherein the integrated flow channel has a rounded rectangular cross-sectional shape.

7. The engine block of claim 1, wherein the integrated flow channel has an irregular concave polygonal cross-sectional shape.

8. The engine block of claim 1, wherein at least 50% of a longitudinal distance between the integrated flow channel and the last cylinder is composed of the coolant passageway.

9. The engine block of claim 1, comprising a first flange mount disposed on the first side of the engine block at a first end of the integrated flow channel, and a second flange mount disposed on the second side of the engine block at a second end of the integrated flow channel.

10. The engine block of claim 1, wherein the cast-aluminum engine block is formed via one of a precision sand casting process, a high pressure die cast process, a low pressure die cast process or a gravity die cast process.

11. The engine block of claim 1, wherein the top deck is disposed to accommodate a cylinder head.

12. An internal combustion engine, comprising:

a cylinder head fluidly coupled to an air intake manifold and an exhaust manifold;

an exhaust gas recirculation valve disposed to regulate the flow of exhaust gas from the exhaust manifold to the air intake manifold;

the cylinder head disposed on an engine block;

the engine block being a cast-aluminum engine block having a first end and a second end in relation to a longitudinal axis, and a first side and a second side in relation to a transverse axis;

the engine block including a plurality of sleeved cylinder barrels defining a plurality of cylinders that are disposed in an in-line arrangement along the longitudinal axis, wherein a last cylinder is defined as being the one of the cylinder barrels that is disposed proximal to the second end;

the engine block including a top portion including a top deck and a bottom portion including a plurality of main bearings that are disposed to support journals of a crankshaft, wherein the top and bottom portions are in relation to an elevation axis, and wherein the cylinder head is disposed on the top deck;

the engine block including a transmission flange disposed at the second end;

an integrated flow channel formed within a portion of the engine block between the second end and the last cylinder and proximal to the top deck, wherein the integrated flow channel is a continuous channel that is aligned with the transverse axis and is disposed to pass from the first side to the second side through the portion of the engine block between the second end and the last cylinder and proximal to the top deck; and a coolant passageway being interposed in the engine block between the integrated flow channel and the last cylinder;

wherein the integrated flow channel is fluidly coupled between the exhaust manifold and the exhaust gas recirculation valve.

13. The internal combustion engine of claim 12, wherein the coolant passageway being interposed in the engine block between the integrated flow channel and the last cylinder is oriented parallel to the elevation axis.

14. The internal combustion engine of claim 13, further comprising a cylinder liner sleeve fabricated from iron being inserted into each of the cylinder barrels.

15. The internal combustion engine of claim 12, further comprising a plurality of air insulation pockets formed in the engine block that are annular to the last cylinder and are interposed between the integrated flow channel and the last cylinder.

16. The internal combustion engine of claim 12, wherein the integrated flow channel has a rounded rectangular cross-sectional shape.

17. The internal combustion engine of claim 12, wherein at least 50% of a longitudinal distance between the integrated flow channel and the last cylinder is composed of the coolant passageway.

18. The internal combustion engine of claim 12, comprising a first flange mount disposed on the first side of the engine block at a first end of the integrated flow channel, and a second flange mount disposed on the second side of the engine block at a second end of the integrated flow channel.

* * * * *